United States Patent [19]

Ishida et al.

[11] Patent Number: 4,770,802

[45] Date of Patent: Sep. 13, 1988

[54] LUBRICATING OIL COMPOSITIONS

[75] Inventors: Noboru Ishida, Kawasaki; Nobuo Yokoyama, Musashino, both of Japan

[73] Assignee: Nippon Oil Co., Ltd., Nishishimbashi, Japan

[21] Appl. No.: 8,967

[22] Filed: Jan. 30, 1987

[30] Foreign Application Priority Data

Feb. 4, 1986 [JP] Japan ..... 61-21241

[51] Int. Cl.[4] ..... C10M 105/64; C10M 107/40; C10M 133/12

[52] U.S. Cl. ..... 252/50; 252/401

[58] Field of Search ..... 252/50, 52 R, 52 S, 252/57, 52 A, 56 S, 51.5 R, 401

[56] References Cited

U.S. PATENT DOCUMENTS

| | | | |
|---|---|---|---|
| Re. 28,805 | 5/1976 | Braid | 252/70 |
| 2,410,652 | 11/1946 | Griffin, Jr. et al. | 252/70 |
| 3,126,344 | 3/1964 | Matuszak et al. | 252/56 S |
| 3,231,499 | 1/1966 | Smith | 252/56 S |
| 3,660,290 | 5/1972 | Schlobohm | 252/70 |
| 3,696,851 | 10/1972 | Randell | 252/70 |
| 3,773,665 | 11/1973 | Braid | 252/50 |
| 3,775,321 | 11/1973 | Turnquest et al. | 252/50 |
| 4,122,021 | 10/1978 | Loveless et al. | 252/70 |

FOREIGN PATENT DOCUMENTS

| | | | |
|---|---|---|---|
| 1359116 | 10/1972 | United Kingdom | 252/50 |

*Primary Examiner*—William R. Dixon, Jr.
*Assistant Examiner*—Margaret B. Medley
*Attorney, Agent, or Firm*—Bucknam and Archer

[57] ABSTRACT

A lubricating oil composition which comprises (I) a base oil selected from mineral oils having an aromatic content of not higher than 30 wt %, synthetic oils which are free of aromatic rings in the structural units, and mixtures thereof, and (II) 0.01 to 5.0 wt %, based on the total composition, of N-p-branched alkylphenyl-alphanaphthylamine which has an alkyl moiety having 12 or 15 carbon atoms and which is derived from a propylene oligomer.

9 Claims, No Drawings

LUBRICATING OIL COMPOSITIONS

BACKGROUND OF THE INVENTION

1. Field of the Invention

This invention relates to lubricating oil compositions utilizable as a lubricant in various industrial fields and more particularly to lubricating oil compositions which have good oxidation stability and in which sludges are difficult to form.

2. Prior Art

As is well known in the art, mineral oils having a low aromatic content and synthetic oils, e.g. poly-alphaolefin oils, which are free of aromatic rings in the structural units, are poor in oxidation stability. When antioxidants are added to the mineral oils or synthetic oils, the resulting lubricating oil compositions exhibit high oil stability. However, a problem involved in these compositions is that the solubility of antioxidants in the oils is low. Antioxidants invariably undergo a degradation when they are oxidized use, and the degraded substances formed by oxidation are left as a sludge.

For the development of long-life lubricating oils, importance should be placed on how to balance this degree of formation of sludge and their service life under oxidizing conditions.

Although phenyl-alpha-naphthylamine is known as a good antioxidant, it has the drawback that the solubility is low and that the solubility of the substances, produced by oxidation dimers, trimers and polymers of these substances is lower. Accordingly, even when high oxidation stability is required, the naphthylamine which has high oxidation stability cannot be used in large amounts in order to improve the oxidation stability of lubricating oils.

In order to improve the solubility of phenyl-alpha-naphthylamine, British Patent No. 1,552,720 discloses a process of alkylating the phenyl group with a propylene trimer. Alternatively, U.S. Pat. No. 3,696,851 discloses a process of alkylating with a propylene dimer or a dimer or trimer of isobutylene. The N-alkylphenyl-alpha-naphthylamines obtained by alkylation of the phenyl group with a propylene or isobutylene dimer or trimer exhibit an improved solubility in oils but have the disadvantage that the solubility of the substances produced by oxidation is still low.

SUMMARY OF THE INVENTION

We have paid attention to the high antioxidizing property of phenyl-alpha-naphthylamine and made intensive studies to overcome the drawbacks that this compound is liable to form a sludge in lubricating oils.

Accordingly, an object of the invention is to provide a lubricating oil composition which comprises a specific type of substituted phenyl-alpha-naphthylamine as an antioxidant for lubricating oils whereby the prior art drawbacks are overcome.

Another object of the invention is to provide a lubricating oil composition which has very high oxidation stability and has no tendency to form.

A further object of the invention is to provide a lubricating oil composition which comprises, as an antioxidant, an N-substituted phenyl-alpha-naphthylamine having a branched alkyl group as the substituent which is derived from an oligomer of propylene.

The above objects can be achieved, according to the invention, by a lubricating oil composition which comprises (I) a base oil selected from the group consisting of mineral oils having an aromatic content of not higher than 30 wt %, synthetic oils having no aromatic rings in the structural units, and mixtures thereof, and (II) 0.01 to 5.0 wt %, based on the total composition, of an N-p-alkylphenyl-alpha-naphthylamine of the following general formula

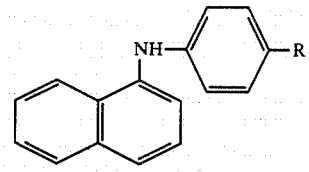

in which R represents a branched alkyl group having 12 or 15 carbon atoms and is derived from an oligomer of propylene. The N-p-alkylphenyl-alpha-naphthylamine is obtained, for example, by reaction between a propylene oligomer having 12 to 15 carbon atoms and phenyl-alpha-naphthylamine. This reaction is preferably carried out in the presence of an activated clay catalyst or a mixed catalyst of activated clay and aluminium chloride.

The base oils used in the present invention should be mineral oils having an aromatic content of 30 wt % or below and/or synthetic oils which do not contain any aromatic rings in the structural units.

The mineral oils suitable for the purpose of the invention have generally a dynamic viscosity at 40° C. of from 10 to 10,000 centistokes, preferably from 20 to 1,000 centistokes. In general, mineral oils are lubricating oil fractions obtained by distillation of crude oils. Preferably, the fractions are refined by suitable techniques such as refining with a solvent, a sulfuric acid treatment, refining by hydrogenation, a clay treatment and the like.

The mineral oil should have an aromatic content of 30 wt % or below, preferably 20 wt % or below. The aromatic content used herein is intended to mean a value which is determined according to the method prescribed in ASTM No. D 2549-81.

The synthetic oils used in the practice of the invention should be free of any aromatic rings in their structural units and have generally a dynamic viscosity at 40° C. of from 10 to 10,000 centistokes. Examples of the synthetic oils include: poly-alpha-olefin oils, such as polybutene and, decene-l-oligomers, obtained by homopolymerization or copolymerization of alpha-olefins having from 4 to 30 carbon atoms; monoesters of aliphatic monocarboxylic acids and aliphatic monohydric alcohols, typical of which are butyl stearate, and methyl laurate; diesters of aliphatic dibasic acids and aliphatic monohydric alcohols such as di-2-ethylhexyl sebacate, dioctyl adipate, and ditridecyl glutarate; aliphatic monocarboxylic acid esters of aliphatic polyhydric alocohols such as trimethylolpropane caprylate, trimethylolpropane pelargonate, pentaerythritol 2-ethylhexanoate, pentaerythritol, and pelargonate; polyalkylene glycols such as the polyethylene glycol, polypropylene glycol, their monoalkyl ethers, dialkyl ethers, monoalkyl esters or dialkyl esters; cycloparaffins such as cyclododecane, hydrindane, bicyclohexyl, tercyclohexyl and the like; alkylcycloparaffins such as dicyclohexylbutane and, dicyclohexylpropane; and mixtures thereof.

The N-p-alkylphenyl-alpha-naphthylamine used in the present invention is a compound of the following general formula

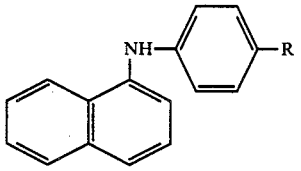

in which R represents a branched alkyl group having 12 or 15 carbon atoms and is derived from an oligomer, i.e. tetramer or pentamer, of propylene.

In the practice of the invention, it is important that R be a branched alkyl group derived from the oligomer of propylene. If the branched alkyl group is derived from an alpha-olefin, the antioxidant property of the resulting product is significantly lower than in the case of N-p-alkylphenyl-alpha-naphthylamine or the component (II) used in accordance with the invention. In addition, when the branched alkyl group is derived from oligomers of olefins other than propylene, e.g. isobutylene, the resulting product is likely to precipitate by oxidation as a sludge when said in lubricating oils.

Moreover, when the branched alkyl group derived from an oligomer of propylene has carbon atoms less than those defined in the invention, the resultant product is likely to precipitate by oxidation as a sludge in lubricating oils. On the other hand, when the number of carbon atoms in the oligomer exceeds the range of the invention, the antioxidizing property becomes poorer since the ratio of the functional group in the molecule becomes smaller. Thus, both cases are unfavorable.

The N-p-alkylphenyl-alpha-naphthylamine used as the component (II) or an antioxidant in the practice of the invention can be prepared by any known techniques. In view of the ease of preparation, it is preferred to use the Friedel-Crafts alkylation reaction between phenyl-alpha-naphthylamine and a propylene oligomer. For the reaction, a variety of catalysts are usable including metal halides such as aluminum chloride, zinc chloride, iron chloride and the like, and acid catalysts such as sulfuric acid, phosphoric acid, phosphorus pentoxide, boron fluoride, acid clay, activated clay and the like. Of these, activated clay is preferred because the resulting product does not aquire color, the reaction rate is high, and the removal of the catalyst is easy. In order to further improve the reaction rate, a mixed catalyst of activated clay and aluminum chloride in a ratio by weight of from 3:1 to 10:1 is preferably used.

The Friedel-Crafts alkylation reaction is generally effected in the following manner.

One mole of phenyl-alpha-naphthylamine, from 2 to 10 moles, preferably from 3 to 5 moles, of a propylene oligomer and from 50 to 200 g, preferably from 80 to 150 g of activated clay or another catalyst are placed into a reaction container equipped with a temperature detector, a nitrogen-introducing pipe, a reflux condenser and a stirrer, followed by heating to 140° to 190° C. while agitating. When aluminum chloride is used in combination with the activated clay as the catalyst, it is added portion by portion in an amount of ⅓ to 1/10 of the amount of the clay used. Thereafter, the reaction is continued at the same temperature, during which sampling is effected at given intervals of time for analysis by a gas chromatography or IR spectrophotometry. The heating and agitating operations were continued until the content of unreacted phenyl-alpha-naphthylamine is below 10%.

After completion of the reaction, the reaction mixture was cooled, from which the catalyst was removed by filtration by suction. The resulting filtrate was distilled under reduced pressure to distill off the unreacted propylene oligomer. The residue was chromatographically purified to obtain a viscous transparent liquid of the intended N-p-alkylphenyl-alpha-naphthylamine.

The amount of the naphthylamine (II) should be from 0.01 to 5.0 wt %, preferably from 0.1 to 3 wt %, of the total composition. Amounts less than 0.01 wt % are not desirable because only a poor effect of the naphthylamine (II) is obtained. On the other hand, when the amount exceeds 5 wt %, no further advantage may be expected with a poor economy.

If necessary, the lubricating oil composition of the invention may further comprise other additives ordinarily used for various purposes including, for example, antioxidants, detergent-dispersants, pour point depressants, viscosity index improvers, oiliness improvers, wear resistant agents, extreme pressure agents, corrosion inhibitors, metal-deactivators, antifoamers, emulsifiers, demulsifiers, bactericides, and colorants. These additives are described in detail, for example, in The Lubrication Journal, Vol. 15, No. 6 or "Additives For Petroleum Products", written by Toshio Sakurai and published by Sachi Bookstore.

The lubricating oil compositions of the invention are utilizable as lubricants requiring oxidation stability including, for example, motorcar engine oils, engine oils for agricultural machines, diesel engine oils, diesel engine oils for ships, industrial multipurpose lubricating oils, turbine oils, hydraulic oils, spindle oils, film bearing oils, refrigerator oils, gear oils, automatic transmission oils, cylinder oils, dynamo oils, machine oils, cutting oils, and metal processing oils.

PREFERRED EMBODIMENTS

The present invention is more particularly described by way of example which should not be construed as limiting the present invention thereto. Comparative examples are also described.

SYNTHETIC EXAMPLE 1

32.9 g (0.15 moles) of phenyl-alpha-naphthylamine and 15 g of activated clay having a specific surface area of 235 $m^2/g$ and an acidity of 1.5 mg-KOH/g were placed on a four-necked flash and heated to 150° C. in a stream of nitrogen. While agitating at a high speed, 101 g (0.6 moles) of propylene tetramer was gradually added in 1 hour. After completion of the addition, the reaction system was reacted for further 5 hours under high-speed agitation at 150° C.

After completion of the reaction, the activated clay was removed by filtration and the resulting filtrate was distilled under reduced pressure to distil off the unreacted propylene tetramer. The resultant residue was chromatographically purified to obtain 48.7 g of N-p-branched dodecylphenyl-alpha-naphthylamine in the form of a transparent, yellow, viscous liquid.

The viscosity of the compound was found to be 1,612 centistokes at 40° C. and the yield based on phenyl-alpha-naphthylamine was 84%.

SYNTHETIC EXAMPLE 2

The procedure of Synthetic Example 1 was followed except that 126 g (0.6 moles) of propylene pentamer was substituted for the propylene tetramer, thereby obtaining 51.6 g of the desired N-p-branched pentadecylphenyl-alpha-naphthylamine.

The viscosity of the compound was 2,182 centistokes at 40° C. and the yield based on the phenyl-alpha-naphthylamine was 80.2%.

SYNTHETIC EXAMPLE 3

32.9 (0.15 moles) of phenyl-alpha-naphthylamine, 15 g of activated clay having a specific surface area of 235 $m^2/g$ and an acidity of 1.5 mg-KOH/g and 3 g of aluminum chloride were placed in a four-necked flask and heated in a stream of nitrogen at 150° C. While agitating at a high speed, 101 g (0.6 moles) of propylene tetramer was gradually added in 3 hours. After completion of the addition, the reaction system was agitated at a high speed while keeping at 150° C., to react for further 1 hour.

After completion of the reaction, the activated clay and aluminum chloride were removed by filtration and the resulting filtrate was transferred to a dropping funnel to wash it with water therein. After completion of the machine, the filtrate was distilled under reduced pressure to distil off the unreacted propylene tetramer. The resultant residue was chromatographically purified to obtain 52.6 g of N-p-branched dodecylphenyl-alpha-naphthylamine in the form of a transparent, yellow, viscous liquid.

The viscosity of the compound was found to be 1,628 centistokes at 40° C. and the yield based on phenyl-alpha-naphthylamine was 90.6%.

COMPARATIVE SYNTHETIC EXAMPLE 1

32.9 g (0.15 moles) of phenyl-alpha-naphthylamine and 15 g of activated clay having a specific surface area of 235 $m^2/g$ and an acidity of 1.5 mg-KOH/g were placed in a four-necked flash and heated in a stream of nitrogen at 150° C. While agitating at a high speed, 75.7 g (0.6 moles) of propylene trimer was gradually added in 1 hour. After completion of the addition, while keeping at 150° C., the system was continuedly agitated at a high speed and reacted for further 5 hours.

After completion of the reaction, the activated clay was removed by filtration and the resulting filtrate was distilled under reduced pressure to distil off the unreacted propylene trimer. The residue was chromatographically purified to obtain 44.3 g of intended N-p-branched nonylphenyl-alpha-naphthylamine in the form of a transparent, yellow, viscous liquid.

COMPARATIVE SYNTHETIC EXAMPLE 2

32.9 g (0.15 moles) of phenyl-alpha-naphthylamine and 3 g of aluminium chloride were placed in a four-necked flask and heated in a stream of nitrogen at 140° C. While agitating at a high speed, 101 g (0.6 moles) of isobutylene trimer was gradually added in 5 hours. After completion of the addition, the reaction product was dissolved in 100 ml of benzene and the solution was washed with water to remove the aluminum chloride, followed by treatment with a rotary evaporator to remove the benzene solvent. The resultant residue was further distilled under reduced pressure to remove the unreacted isobutylene trimer, followed by recrystallization from an ethanol aqueous solution to obtain 21.2 g of intended N-p-branched dodecylphenyl-alpha-naphthylamine as white crystals having a melting point of 116° C.

EXAMPLES 1-3 AND COMPARATIVE EXAMPLES 1-4

Substances produced by oxidation of the N-p-alkylphenyl-alpha-naphthylamines (II) obtained in Synthetic Examples 1 to 3 (these substances being formed when the naphthylamine derivatives serve as an antioxidant) were added, in amounts indicated in Table 1, to a refined mineral oil having an aromatic content of 7 wt % and a dynamic viscosity of 34.4 centistokes at 40° C. and also to a polyalpha-olefin oil (decene-l-oligomer) having a dynamic viscosity of 30.7 centistokes at 40° C. The solubility of the substances was evaluated (Examples 1 to 3). The results are shown in Table 1.

For comparison, as indicated in Table 1, commercially available antioxidants including phenyl-alpha-naphthylamine and N-p-branched octylphenyl-alpha-naphthylamine prepared by using an isobutylene dimer as an alkyl source, the N-p-branched nonylphenyl-alpha-naphthylamine obtained in Comparative Synthetic Example 1, and the N-p-branched dodecylphenyl-alpha-naphthylamine (alkyl source in comparative Synthetic Example 2: isobutylene trimer) obtained in Comparative Synthetic Example 2 were each evaluated for the solubility of the substances produced by oxidation in base oils. The results are also shown in Table 1.

The produced by oxidation substances of the phenyl-alpha-naphthylamine and the N-p-alkylphenyl-alpha-naphthylamines were those which were formed in the following manner using the R. F. Bridger method (J. Org. Chem. Vol. 33, No. 12 (1968)).

0.05 moles of phenyl-alpha-naphthylamine or an N-p-alkylphenyl-alpha-naphthylamine was dissolved in 100 ml of acetone and cooled to 0° C. 2.65 g of potassium permanganate was gradually added to the solution in 5 hours, followed allowing it to stand at room temperature for 15 hours. During this time, the system was kept in an atmosphere of nitrogen. The resultant manganese dioxide was removed by filtration through a filter paper and the acetone was distilled off from the filtrate, followed by dissolution of the residue in 100 ml of benzene washing with water and removal of the benzene by distillation.

The resultant product was subjected to analysis of with IR absorption spectrum, a GPC analysis and mass analysis. From the results of these analyses, the product was found to be mainly composed of substances and produced by oxidation dimers and trimers thereof. The substances so produced are referred to hereinafter as "oxidatively produced substances".

EXAMPLES 4-6 AND COMPARATIVE EXAMPLES 5-8

In order to determine the antioxidizing property of the N-p-alkylphenyl-alpha-naphthylamines as component (II) of the invention obtained in Synthetic Examples 1 to 3, these compounds were each added, in an amount indicated in Table 1, to a refined mineral oil of the same type as used in Examples 1 to 3. The resulting lubricating oil compositions were subjected to a rotating bomb oxidation test as prescribed in ASTM No. D 2272 under conditions of a test temperature of 150° C. and an oxygen pressure of 13 $kg/cm^2$ and by the use of a copper wire catalyst. The antioxidizing property was evaluated according to the time before the oxygen pressure lowered to 1.8 kg/cm$^2$ (Examples 4–6). The test results are shown in Table 2.

For comparison, the antioxidizing property of the phenyl-alpha-naphthylamine and the N-p-alkylphenyl-alpha-naphthylamines used in Comparative Examples 1 to 4 was also assessed (Comparative Examples 5 to 8). The results are also shown in Table 2. It will be noted that in Comparative Examples 5 to 7, the compounds indicated in Table 2 are added in large amounts to raise a practical problem, that is sufficient to form the oxidatively produced substances with a fear of forming a sludge. This will be understood from the results of Comparative Examples 1 to 3 in Table 1.

TABLE 1

| Compounds Added | Refined Mineral Oil *1 Amount (wt %) | Refined Mineral Oil *1 added Solubility | Poly-alpha-Olefin Oil *2 Amount (wt %) | Poly-alpha-Olefin Oil *2 added Solubility |
|---|---|---|---|---|
| Example: | | | | |
| 1 oxidatively produced and in | 3.0 | soluble | 3.0 | soluble |
| Comparative substance of N—p-branched dodecylphenyl-alpha-naphthylamine (Synthetic Example 1) | 4.0 | soluble | 4.0 | soluble |
| 2 oxidatively produced and in | 3.0 | soluble | 3.0 | soluble |
| Comparative substance of N—p-branched pentadecylphenyl-alpha-naphthylamine (Synthetic Example 2) | 4.0 | soluble | 4.0 | soluble |
| 3 oxidatively produced and in | 3.0 | soluble | 3.0 | soluble |
| Comparative substance of N—p-branched dodecylphenyl-alpha-naphthylamine (Synthetic Example 3) | 4.0 | soluble | 4.0 | soluble |
| Comparative Example: | | | | |
| 1 oxidatively produced and in Comparative | 0.1 | soluble | 0.1 | soluble |
| substance of phenyl-alpha-naphthylamine | 0.2 | partially insoluble | 0.2 | partially insoluble |
| 2 oxidatively produced and in | 0.5 | soluble | 0.5 | soluble |
| Comparative substance of N—p-branched octylphenyl-alpha-naphthylamine *3 | 1.0 | partially insoluble | 1.0 | partially insoluble |
| 3 oxidatively produced and in | 3.0 | soluble | 3.0 | soluble |
| Comparative substance of N—p-branched nonylphenyl-alpha-naphthylamine (Comp. Syn. Ex. 1) | 3.5 | partially insoluble | 3.5 | partially insoluble |
| 4 oxidatively produced and in | 1.0 | soluble | 1.0 | soluble |
| Comparative substance of N—p-branched dodecylphenyl-alpha-naphthylamine (isobutylene trimer base: Comp. Syn. Ex. 2) | 3.0 | partially insoluble | 3.0 | partially insoluble |

*1 Refined mineral oil having an aromatic content of 7 wt % (dynamic viscosity of 34.4 centistokes, at 40° C.
*2 Decene-1-oligomer (dynamic viscosity of 30.7 centistokes, at 40° C.

*3

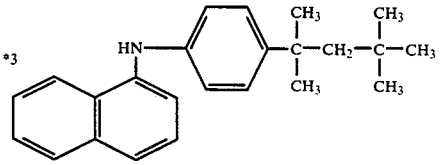

TABLE 2

| Compounds Added | Amount added (wt %) | Antioxidizing Property (Hrs.) |
|---|---|---|
| Example: | | |
| 4 N—p-branched dodecylphenyl-alpha-naphthylamine (Synthetic Ex. 1) | 1.0 | 1,820 |
| | 1.5 | 2,580 |
| 5 N—p-branched pentadecylphenyl-alpha-naphthylamine (Synthetic Ex. 2) | 1.5 | 2,410 |
| 6 N—p-branched dodecylphenyl-alpha-naphthylamine (Synthetic Ex. 3) | 1.5 | 2,540 |
| Comparative Example: | | |
| 5 phenyl-alpha-naphthylamine | 0.2 | 1,190 |
| 6 N—p-branched octylphenyl-alpha-naphthylamine | 1.0 | 1,930 |
| 7 N—p-branched nonylphenyl-alpha-naphthylamine (Comp. Synthetic Ex. 1) | 1.0 | 1,850 |
| 8 N—p-branched dodecylphenyl-alpha-naphthylamine (isobutylene timer base: Comp. Synthetic Ex. 2) | 1.0 | 1,770 |

As will be apparent from the results of Table 1, the N-p-alkylphenyl-alpha-naphthylamine which is used as one of the essential ingredients according to the invention is advantageous in that the substances formed by oxidation of the naphthylamines do rarely form a sludge. Accordingly, it is possible to add it, as an antioxidant, in large amounts to lubricating base oils. In contrast, the commercially available antioxidants, i.e. phenyl-alpha-naphthylamine (Comparative Example 1) and N-p-branched octylphenyl-alpha-naphthylamine (Comparative Example 2), are significantly inferior to the compounds of Examples 1 to 3 with respect to the solubility of the oxidatively produced substance. This means that these commercial antioxidants cannot be used in large amounts because sludges may be formed.

Moreover, with N-p-branched nonylphenyl-alpha-naphthylamine (Comparative Example 3) in which a propylene oligomer is used as an alkyl source as in the present invention except that the alkyl group has less carbon atoms, or with N-p-branched dodecylphenyl-alpha-naphthylamine (Comparative Example 4) in which an isobutylene oligomer is used as the alkyl source having such carbon atoms within the scope of the invention, the solubility of the substances produced by oxidation of these compounds is are inferior to the compounds (II) of the invention.

The results of Table 2 reveal that the lubricating oil compositions of Examples 4 to 6 have the advantage that since the components (II) of the invention and their substances produced by oxidation substances have good solubility in the oil, the compounds can be added in any amounts without a fear of sludge formation. As will be apparent from the results of the antioxidizing property in Example 4, if high oxidation stability is required, the amount of component (II) can be increased to satisfy the requirement.

Some of the compositions of Comparative Examples 5 to 8 are similar in antioxidizing property to the composition of the invention using the components (II). However, the amount of the naphthylamine components used in the comparative compositions must be limited from the standpoint of the sludge formation as will be apparent from the results of Comparative Examples 1 to 4. Thus, the lubricating oil compositions for comparison cannot exhibit so high an oxidation stability as the compositions of the invention. In the compositions of Comparative Examples 5 to 6, the antioxidant compounds are added in such large amounts that sludges may be formed, and thus the antioxidizing property of the compositions for comparison is not practically so high as is shown in Table 2.

What is claimed is:

1. A lubricating oil composition which consists essentially of (I) a base oil which is a member selected from the group consisting of mineral oils having an aromatic content not higher than 30 wt %, synthetic oils having no aromatic rings in the structural units, and mixtures thereof, and (II) 0.01 to 5.0 wt %, based on the total composition, of an N-p-alkylphenyl-alpha-naphthylamine of general formula

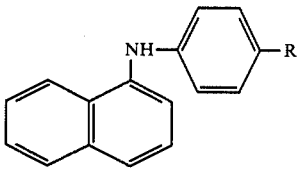

in which R represents a branched alkyl group having 12 or 15 carbon atoms and is derived from an oligomer of propylene.

2. A lubricating oil composition according to claim 1, wherein said N-p-alkylphenyl-alpha-naphthylamine is N-p-branched dodecylphenyl-alpha-naphthylamine.

3. A lubricating oil composition according to claim 1, wherein said N-p-alkylphenyl-alpha-naphthylamine is N-p-branched pentadecylphenyl-alpha-naphthylamine.

4. A lubricating oil composition according to claim 1, wherein said N-p-alkylphenyl-alpha-naphthylamine is a product obtained by reaction between a propylene oligomer having 12 or 15 carbon atoms and phenyl-alpha-naphthylamine.

5. A lubricating oil composition according to claim 4, wherein the reaction is carried out in the presence of an activated clay catalyst or a mixed catalyst or activated clay and aluminium chloride.

6. A lubricating oil composition according to claim 5, wherein the mixed catalyst of activated clay and aluminium chloride is a mixture in a ratio by weight of 3 to 10:1.

7. A lubricating oil composition according to claim 1, wherein said base oil is a mineral oil having an aromatic content of not higher than 30 wt % and having a dynamic viscosity from 10 to 10,000 centistokes at 40° C.

8. A lubricating oil composition according to claim 1, wherein said base oil is synthetic oil having a dynamic viscosity of from 10 to 10,000 centistokes at 40° C.

9. A lubricating oil composition according to claim 1, wherein the amount of the N-p-alkylphenyl-alpha-naphthylamine ranges from 0.1 to 3 wt %.

* * * * *

UNITED STATES PATENT AND TRADEMARK OFFICE

CERTIFICATE OF CORRECTION

PATENT NO. : 4,770,802

DATED : September 13, 1988

INVENTOR(S) : Noboru Ishida et al.

It is certified that error appears in the above-identified patent and that said Letters Patent is hereby corrected as shown below:

On the title page, item [75], add the third inventor -- Hiroyuki Takashima, Yokohama, --.

Signed and Sealed this

Seventh Day of November, 1989

*Attest:*

JEFFREY M. SAMUELS

*Attesting Officer*

*Acting Commissioner of Patents and Trademarks*